US009656788B2

(12) United States Patent
Montgomery et al.

(10) Patent No.: US 9,656,788 B2
(45) Date of Patent: May 23, 2017

(54) PACKAGING ASSEMBLY FOR A REPLACEMENT MOWER BLADE

(71) Applicant: MTD PRODUCTS INC, Valley City, OH (US)

(72) Inventors: Matthew Montgomery, Plymouth, OH (US); Aaron Morton, Mansfield, OH (US); Jeffrey Wolf, Strongsville, OH (US); Edward Mohler, Columbia Station, OH (US)

(73) Assignee: MTD PRODUCTS INC, Valley City, OH (US)

( * ) Notice: Subject to any disclaimer, the term of this patent is extended or adjusted under 35 U.S.C. 154(b) by 583 days.

(21) Appl. No.: 14/037,471

(22) Filed: Sep. 26, 2013

(65) Prior Publication Data

US 2014/0091004 A1 Apr. 3, 2014

Related U.S. Application Data

(60) Provisional application No. 61/707,414, filed on Sep. 28, 2012.

(51) Int. Cl.

| | |
|---|---|
| ***B65D 71/08*** | (2006.01) |
| ***B65D 75/00*** | (2006.01) |
| ***B65D 75/56*** | (2006.01) |
| *B65B 53/02* | (2006.01) |
| *B65B 15/00* | (2006.01) |

(52) U.S. Cl.

CPC ..... *B65D 71/08* (2013.01); *B65D 75/004* (2013.01); *B65D 75/56* (2013.01); *B65B 15/00* (2013.01); *B65B 53/02* (2013.01)

(58) Field of Classification Search

CPC .... B65D 75/002; B65D 75/004; B65D 75/56; B65D 71/08; B65D 71/10; B65D 73/0064; B65D 5/4208; B25H 3/00

USPC ..... 206/349, 461, 471, 497, 806; 40/662; 56/255, 295; 53/440–442

See application file for complete search history.

(56) References Cited

U.S. PATENT DOCUMENTS

| | | | | |
|---|---|---|---|---|
| 3,259,231 A * | 7/1966 | Romanowski | B65D 85/00 | 206/349 |
| 3,764,002 A * | 10/1973 | Spiegel | B65D 75/00 | 206/497 |
| 3,885,667 A * | 5/1975 | Spiegel | B65D 75/54 | 206/497 |
| 4,764,028 A * | 8/1988 | Wood | B65D 33/14 | 206/497 |
| 5,020,669 A * | 6/1991 | Nakagoshi | B65D 71/10 | 206/497 |
| 6,401,924 B1 * | 6/2002 | Fresnel | B65D 73/0064 | 206/497 |

(Continued)

*Primary Examiner* — Luan K Bui

(74) *Attorney, Agent, or Firm* — Wegman, Hessler & Vanderburg; Benjamin Cotton; Jason Worgull

(57) ABSTRACT

A package assembly for packaging a replacement mower blade is provided. The package assembly includes a blade hang tab removably attached to an end of a mower blade. A shrink film tube is positioned about the mower blade and blade hang tab, wherein the shrink film is heated to shrink the shrink film and secure the blade hang tab to the mower blade. In another embodiment, the package assembly includes multiple blades encased within shrink film with a blade hang tab attached to one of the blades within the shrink film.

8 Claims, 5 Drawing Sheets

(56) References Cited

U.S. PATENT DOCUMENTS

| | | | | |
|---|---|---|---|---|
| 7,997,410 | B2 * | 8/2011 | Ali | B65D 73/0014 206/495 |
| 8,322,529 | B2 * | 12/2012 | Titkos | B65D 73/0064 206/497 |
| 2003/0034316 | A1 * | 2/2003 | Kao | B25H 3/04 206/806 |
| 2011/0168597 | A1 * | 7/2011 | Titros | B65D 73/0064 206/495 |
| 2012/0048946 | A1 * | 3/2012 | Norman | G09F 3/08 206/497 |

* cited by examiner

PACKAGING ASSEMBLY FOR A REPLACEMENT MOWER BLADE

This application claims benefit of 61/707,414 filed on Sep. 28, 2012.

FIELD OF THE INVENTION

The present invention is directed to displaying a mower blade in a retail merchandise store, and more particularly, to the method of packaging the mower blade to support the mower blade when hung for display.

BACKGROUND OF THE INVENTION

Riding and walk-behind lawn mowers used to cut grass may sometimes contact rocks, hardscaping, or other hard objects which render the mower blade dull or otherwise less than effective at cutting grass. Additionally, extended general use of the mower blade(s) will also act to dull the blade(s). As a result, after-market replacement blades are typically sold in retail stores or through distributors or dealers for use by the consumer to replace the dull or otherwise ineffective mower blades instead of having the blade sharpened.

When the replacement mower blades are displayed in a store or dealership, the mower blades are typically packaged by placing the blade within a plastic sleeve wrap by an operator, and the sleeve wrap and mower blade are then placed onto a conveyor belt which transports them through a heater which causes the plastic to shrink around the blade. A hang tab is then adhesively attached to the outside of the shrunken plastic, which allows the replacement mower blade to be hung or otherwise displayed in the retail store or distributor. However, these adhesive hang tabs either do not readily stick to the plastic or they fall of due to the weight of the mower blade in which the adhesive has insufficient strength to remain attached to the plastic.

Another packaging process for replacement mower blades is encasing the replacement mower blade in a plastic clamshell package which has a hang hole formed therein. The clamshell package is typically a somewhat bendable plastic piece that is folded about the mower blade and then sealed to ensure the mower blade remains inside the packaging. This clamshell package is often difficult to open by a customer.

These packages for replacement mower blades are typically expensive and decrease the profit margin on the sale of the replacement blade. Additionally, the packaging also often does not maintain the mower blade in a displayed position, wherein the blades often separate from the packaging or the tab falls off which results in a pile of replacement blades at the bottom of the display.

Therefore, a need exists for a cheaper method of packaging replacement blades to be displayed in retail locations. A need also exists for a mower blade package that can withstand the weight of the mower blade in a displayed position.

BRIEF SUMMARY OF THE INVENTION

In one aspect of the present invention, a package assembly for at least one replacement mower blade is provided. The package assembly includes at least one mower blade and a blade hang tab removably attachable to one of the at least one mower blade. The package assembly also includes a shrink film encasing the at least one mower blade and the blade hang tab attached to one of the at least one mower blade.

In another aspect of the present invention, a method for packaging at least one replacement mower blade is provided. The method includes providing at least one mower blade and attaching a blade hang tab to one of the at least one mower blade. The method further includes forming a tube of shrink film and sealing one end of the tube of shrink film. Subsequently, the method includes positioning the at least one mower blade and the blade hang tab within the sealed tube and sealing a second end of the tube of shrink film such that the at least one mower blade and the blade hang are encased therewithin. Finally, the method includes heating the shrink film with the at least one mower blade and the blade hang tab therewithin.

In yet another aspect of the present invention, a method for packaging at least one replacement mower blade is provided. The method includes forming a package assembly, wherein the package includes at least one mower blade, a blade hang tab removably attached to one of the at least one mower blade, and a sealed tube of shrink film encasing the at least one mower blade and the blade hang tab. The method also includes heating the package assembly to cause the shrink film to shrink.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1:
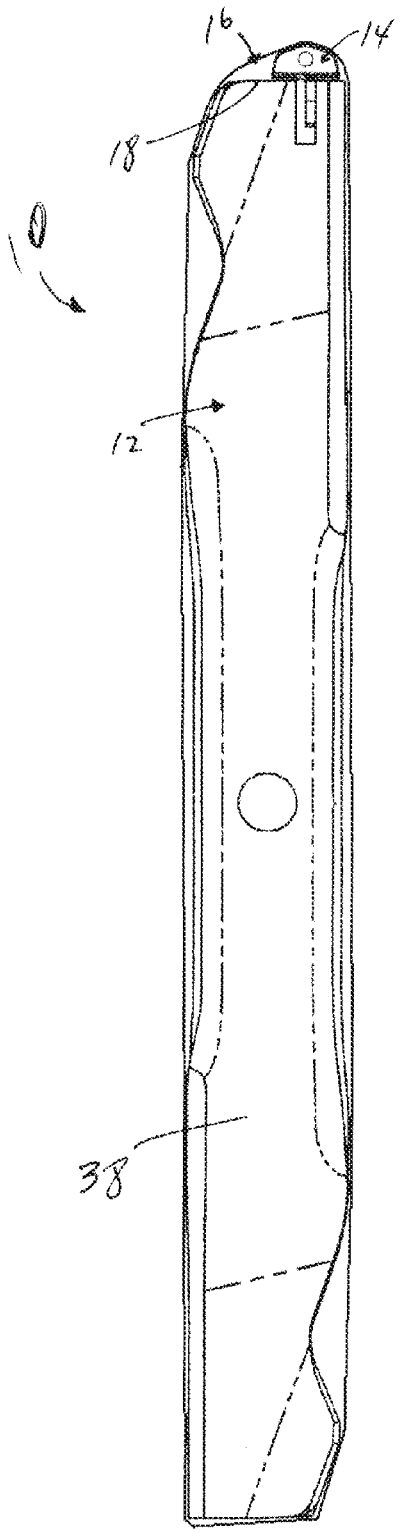
FIG. 1 is a front view of a package assembly having a mower blade, a blade hang tab, and shrink film.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Figure 2:
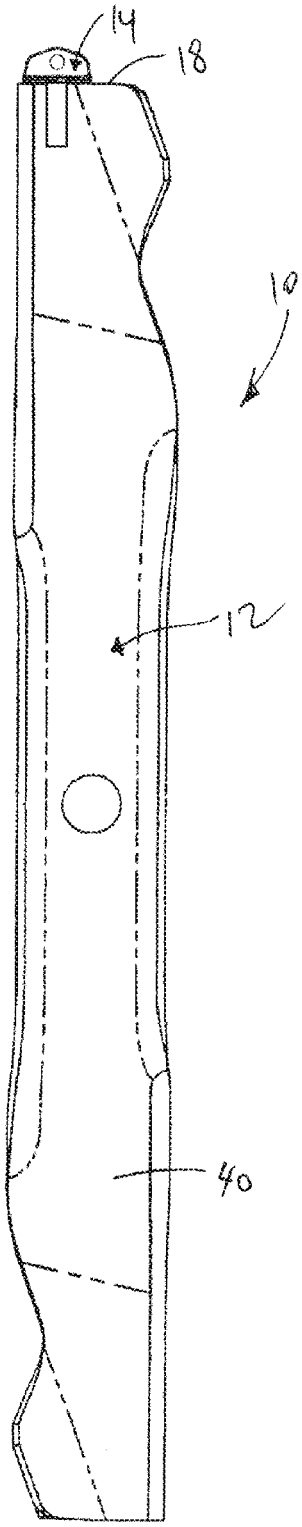
FIG. 2 is a rear view of a blade hang tab attached to a mower blade.
Figure 3A:
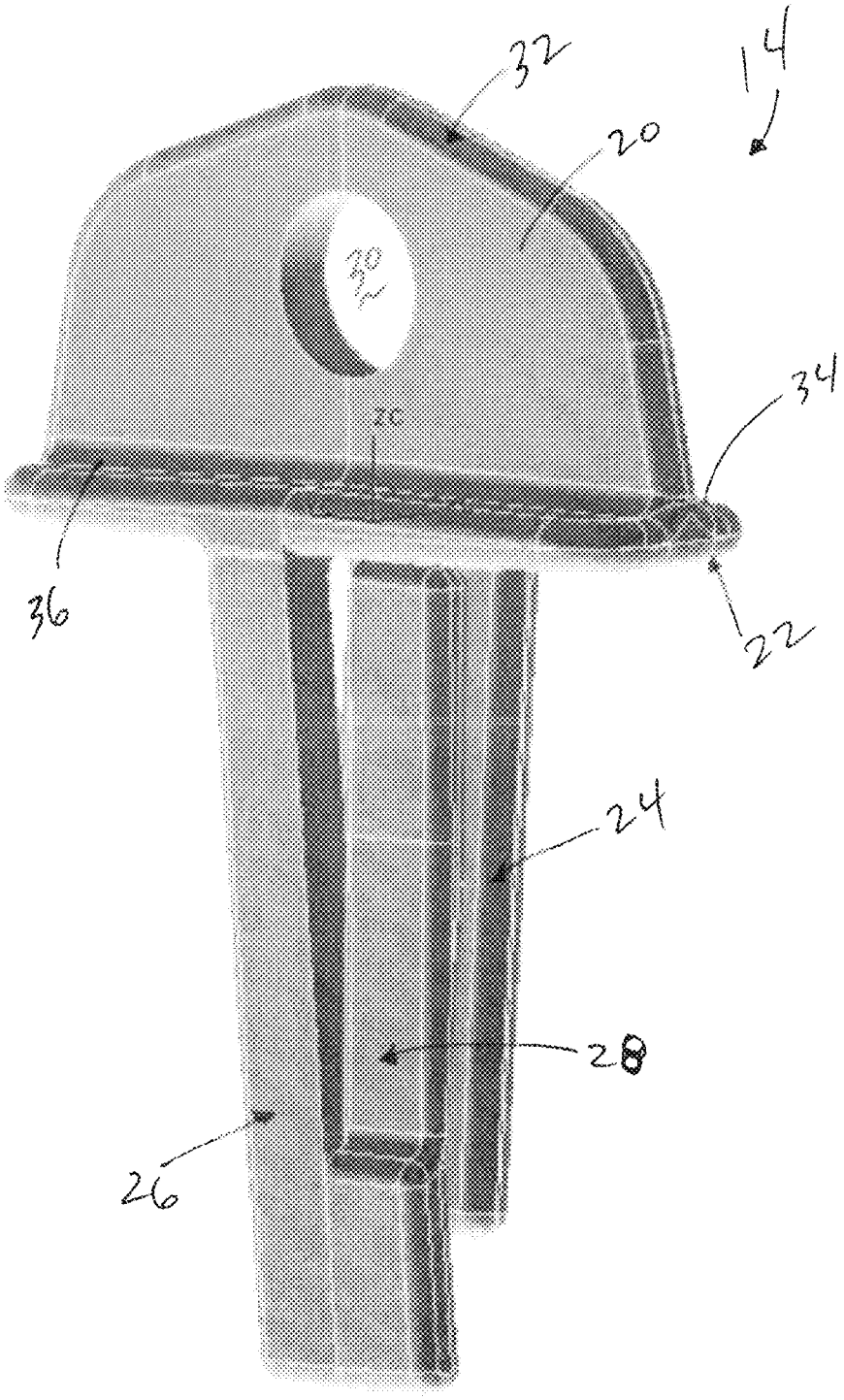
FIG. 3A is a perspective view of an embodiment of a blade hang tab.
Figure 3E:
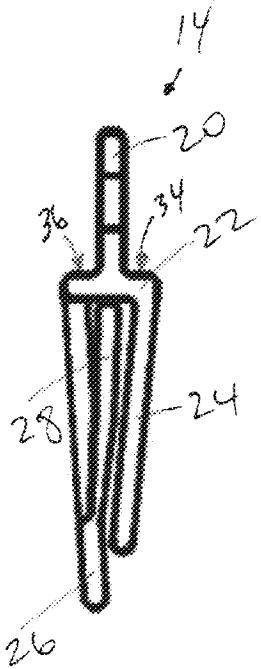
FIG. 3E is a left side view of the blade hang tab shown in FIG. 3A.
Figure 3D:
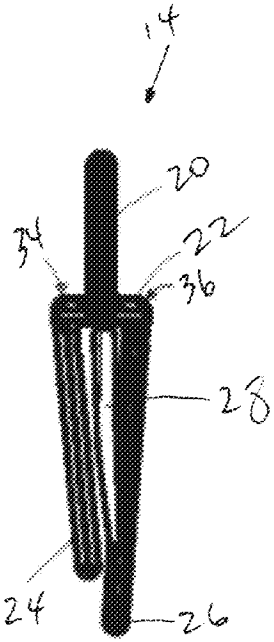
FIG. 3D is a right side view of the blade hang tab shown in FIG. 3A.
Figure 3C:
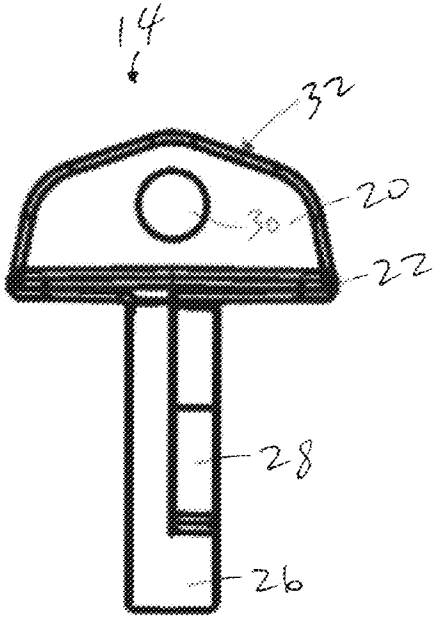
FIG. 3C is a rear view of the blade hang tab shown in FIG. 3A.
Figure 3B:
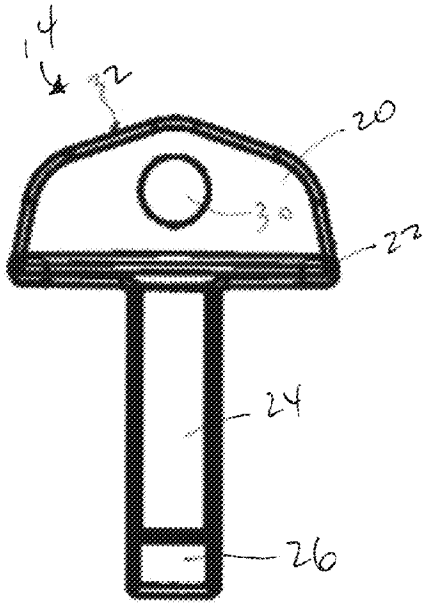
FIG. 3B is a front view of the blade hang tab shown in FIG. 3A.

Referring to FIGS. 1-2, an embodiment of a mower blade package assembly 10 is shown. The package assembly 10 includes at least one replaceable mower blade 12, a blade hang tab 14 operatively connected to the mower blade(s) 12, and a shrink film 16 surrounding the mower blade 12 and blade hang tab 14. FIG. 2 illustrates a rear view of the mower blade 12 and blade hang tab 14 without the shrink film 16. In the illustrated embodiment, the blade hang tab 14 is attached to a single mower blade 12 which is encased in the shrink film 16. In another embodiment, the package assembly 10 includes three (3) mower blades 12 bunched together within the shrink film 16. In a further embodiment, the package assembly 10 includes six (6) mower blades 12 bunched together within the shrink film 16. It should be understood by one of ordinary skill in the art that any number of blades can be included in the package assembly 10.

The blade hang tab 14 is operatively attached to a distal end 18 of a mower blade 12 prior to the pair being encased within the shrink film 16, as shown in FIG. 2. The blade hang tab 14 is releasably attached to the mower blade 12 by sliding the blade hang tab 14 over the edge of the distal end 18 of the mower blade 12 such that the blade hang tab 14 contacts both the front and rear surfaces of the mower blade 12 and the mower blade 12 is positioned between separate portions of the blade hang tab 14 in a scissor-like or sandwich-like manner. The blade hang tab 14 is illustrated as being attached to a mulching mower blade 12, but it should be understood by one of ordinary skill in the art that the mower blade 12 can be any type of blade attachable to a rotary mower including, but not limited to, a flat cutting blade, a mulching blade, a blower blade, or the like.

FIGS. 3A-3E illustrate an exemplary embodiment of a blade hang tab 14. In an embodiment, the blade hang tab 14 includes a hang member 20, a base member 22, a first leg 24, a second leg 26, and a third leg 28. The hang member 20 is formed as a substantially flat member having an aperture 30 formed through the thickness thereof. The hang member 20 is elongated in the lateral direction and has a curved upper edge 32. The upper edge 32 has a generally upside-down U-shape, and the upper edge 32 forms a rounded corner such to reduce or eliminate potential cutting of the shrink film 16 that may occur with square corners. The lateral width of the upper edge 32 provides a sufficient surface area for the upper edge 32 to fully support the weight of the mower blade(s) encased in the shrink film 16 for the package assembly 10.

The base member 22 of the blade hang tab 14 is oriented substantially perpendicular to the hang member 20, as shown in FIGS. 3A-3E. The base member 22 extends both forward and rearward of the hang member 20. The base member 22 provides a transition between the hang member 20 and the first and second legs 24, 26 that extend downwardly therefrom. The base member 22 includes a forward end 34 and a rearward end 36, wherein the forward end 34 extends forward from the hang member 20 and the rearward end 36 extends rearward from the hang member 20.

A first leg 24 extends from the forward end 34 of the base member 22 in a direction opposite the hang member 20, as shown in FIGS. 3A-3E. The first leg 24 is an elongated member extending from the forward end 34 in a spaced-apart manner from the hang member 20. The first leg 24 extends downwardly at an angle relative to the base member 22 such that the first leg 24 is directed slightly rearward toward the center of the base member 22. In an embodiment, the width of the first leg 24 is less than the width of the base member 22. In another embodiment, the width of the first leg 24 is the same as the width of the base member 22.

A second leg 26 extends from the rearward end 36 of the base member 22 in a direction opposite the hang member 20, as shown in FIGS. 3A-3E. The second leg 26 is an elongated member extending from the rearward end 36 in a spaced-apart manner from the hang member 20. The second leg 26 extends downwardly at an angle relative to the base member 22 such that the second leg 26 is directed slightly forward toward the center first leg 24. In an embodiment, the width of the second leg 26 is less than the width of the base member 22. The first and second legs 24, 26 extend from opposing ends of the base member 22 and are angled from the base member 22 toward each other such that the tips of each of the first and second legs 24, 26 is positioned closer together than the opposing ends that are attached to the base member 22. In an embodiment, the first leg 24 and the second leg 26 are substantially the same length. In the illustrated embodiment, the first leg 24 is slightly shorter than the second leg 26. In an embodiment, the first leg 24 is substantially the same width as a portion of the second leg 26. In another embodiment, the second leg 26 has a different width than the first leg 24. In the illustrated embodiment, the width of the second leg 26 adjacent to the base member 22 is substantially smaller than the width of the first leg 24, but the width of the second leg 26 adjacent the tip of thereof is substantially the same width of the first leg 24.

In the illustrated embodiment, the blade hang tab 14 includes a third leg 28 operatively connected to the second leg 26 and extending therefrom. It should be understood by one of ordinary skill in the art that the third leg 28 is optional, and an alternative embodiment includes a second leg 26 having a continuous width along the length thereof without the third leg 28 extending therefrom. The third leg 28 extends from the second leg 26 at a position adjacent to the tip of the second leg 26. The third leg 28 extends from the second leg 26 such that the tip of the third leg 28 is adjacent to the lower surface of the base member 22. The third leg 28 extends at an angle from the second leg 26 such that the tip of the third leg 28 is adjacent to the center of the base member 22, wherein the third leg 28 is angled toward the first leg 24. The second and third legs 26, 28 for a somewhat V-shaped extension from the base member 22. In an embodiment, the combined width of the second leg 26 and the third leg 28 is substantially the same as the width of the first leg 24.

In an embodiment, the blade hang tab 14 is formed by injection molding a plastic or other substantially strong yet flexible material. Each member of the blade hang tab 14 is integrally formed together to provide a unitary piece that is removably attachable to at least one mower blade 12.

In an embodiment, the blade hang tab 14 can be formed of glass-filled nylon, high density polyethylene (HDPE), nylon 6-6, or any other formable plastic. The shrink film 16 can be formed of polyolefin, CorTuff®, or any other plastic film configured as a heat-shrink film.

The method of assembling the package assembly 10 involves mounting a roll of shrink film 16, wherein the roll of shrink film 16 is formed into a round tunnel in which the lateral edges of the shrink film 16 are sealed together to form a continuous round tube of shrink film 16. This tube of shrink film 16 is then sealed at a downstream end. An operator attaches a blade hang tab 14 to a single mower blade 12. If the package assembly 10 includes only one mower blade 12 contained therein, the mower blade 12 and blade hang tab 14 attached thereto are placed onto a conveyor which transports them into the tube of shrink film 16 having a sealed end. Alternatively, if the package assembly 10 includes more than one mower blade 12 contained therein, the mower blades 12 are bunched together and one blade hang tab 14 is attached to one of the mower blades 12 and the bundle are then placed onto the conveyor which transports them into the tube of shrink film 16 having a sealed end. It should be understood by one of ordinary skill in the art that in package assemblies 10 having multiple mower blades 12, more than one blade hang tab 14 can be attached to separate mower blades 12; however, a single blade hang tab 14 and shrink film 16 surrounding the bundle have sufficient strength to maintain the multiple mower blades 12 encased within shrink film 16.

Once the blade hang tab 14 is attached to the mower blade(s) 12 are received in the shrink film 16 having a first sealed end, the opposing end is sealed, thereby encasing the mower blade(s) 12 and the blade hang tab 14 therewithin. The sealing of the second end of the shrink film 16 tube also provides for the first sealed end for the subsequent blade hang tab 14 and mower blade(s) 12 bundle. Once the blade hang tab 14 and mower blade(s) 12 have been encased within the shrink film 16, the entire package assembly 10 is transferred to a heating unit that causes the shrink film 16 to reduce in size and conform to the shape of the mower blade(s) 12 and the blade hang tab 14. This process is then repeated for the next set of mower blade(s) 12 and a blade hang tab 14. Once the shrink film 16 has been heated and shrunken, the package assembly 10 is complete and can be packaged for shipment or placed directly onto a retail hook for display.

As explained above, the blade hang tab 14 is attached to a distal end 18 of a mower blade 12 of a package assembly 10, as shown in FIGS. 1-2. The blade hang tab 14 is releasably attached to the mower blade such that the distal end 18 of the mower blade 12 is positioned adjacent to the base member 22 of the blade hang tab 14 and one of the first or second leg 24, 26 slides over and contacts the front surface 38 of the mower blade 12 and the other of the first or second leg 24, 26 slides over and contacts the rear surface 40 of the mower blade 12. When the tip of the second leg 26 contacts the front or rear surface 38, 40 of the mower blade 12, the tip of the third leg 28 likewise contacts the same surface of the mower blade 12. The first and second legs 24, 26 have elastic properties such that they act as springs or are otherwise biased against the opposing front and rear surfaces 38, 40 of the mower blade 12 to ensure the blade hang tab 14 remains engaged with the distal end 18 of the mower blade 12 as the pair are transferred into the shrink film 16 and during the heating process to shrink the shrink film 16. The optional third leg 28 provides additional spring bias against the surface of the mower blade 12 to provide additional gripping force and an additional contact surface against the surface of the mower blade 12. It should be understood by one of ordinary skill in the art that the first and second legs 24, 26 of the blade hang tab 14 extend from the base member 22 in a cantilevered manner such that the tips of each leg is spaced apart from each other a distance that is less than the distance between the locations at which each leg attaches to the base member 22. Further, the spacial distance between the tips of the first and second legs 24, 26 is less than the thickness of the mower blade 12, thereby causing the tips to separate and each leg acting as a cantilevered spring to bias against an opposing surface of the mower blade 12. This spring force from the first and second legs 24, 26 assists in positively positioning the blade hang tab 14 on the mower blade 12.

In addition to the spring force from the first, second, and third legs 24, 26, 28 against the front and rear surfaces 38, 40 of the mower blade, the shrink film 16 provides additional structural support to maintain the attachment between the blade hang tab 14 and the mower blade 12 as well as support the weight of the mower blade 12 when the package assembly 10 is hung from a retail hook inserted through the aperture 30 in the hang member 20. It should be understood by one of ordinary skill in the art that the strength of the shrink film 16 should be sufficient to support the weight of the mower blade(s) 12 that are encased therein when hung from a retail hook on display.

In an alternative embodiment, the blade hang tab 14 is attached to the distal end 18 of the mower blade 12 in an automated manner without an operator action.

By automating the positioning of the mower blade 12 and mower blade hang tab within the shrink film 16 in which the opposing ends of the shrink film 16 are sealed in an automated manner without an operator action, the manual or operator actions required to generate a packaging assembly 10 is reduced. Further, by attaching the blade hang tab 14 to the end of the mower blade 12 such that the blade hang tab 14 is located within the shrink film 16, the likelihood of the blade hang tab becoming dislodged from the mower blade 12 or otherwise cause the mower blade to fall from a retail hook is reduced.

Figure 4C:
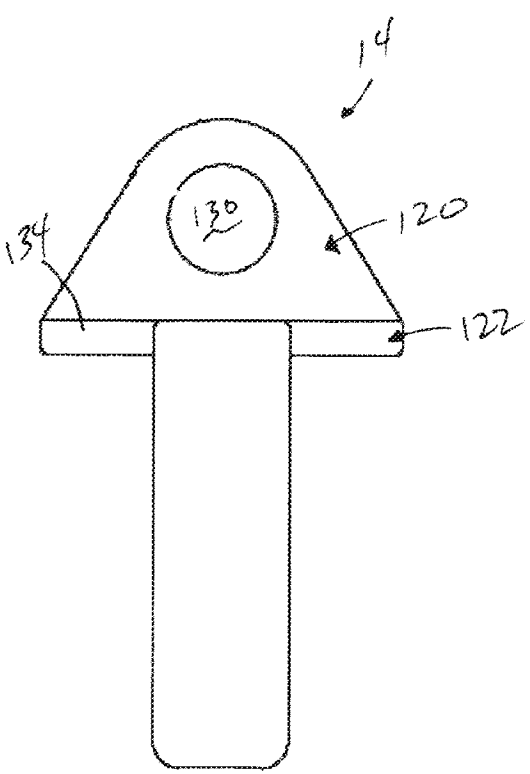
FIG. 4C is a front view of the blade hang tab shown in FIG. 4A.
Figure 4B:
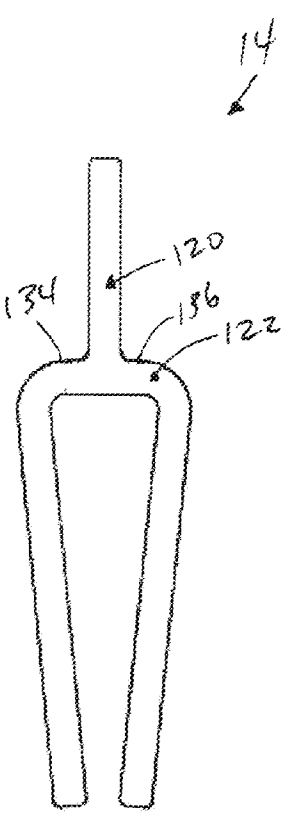
FIG. 4B is a side view of the blade hang tab shown in FIG. 4A.
Figure 4A:
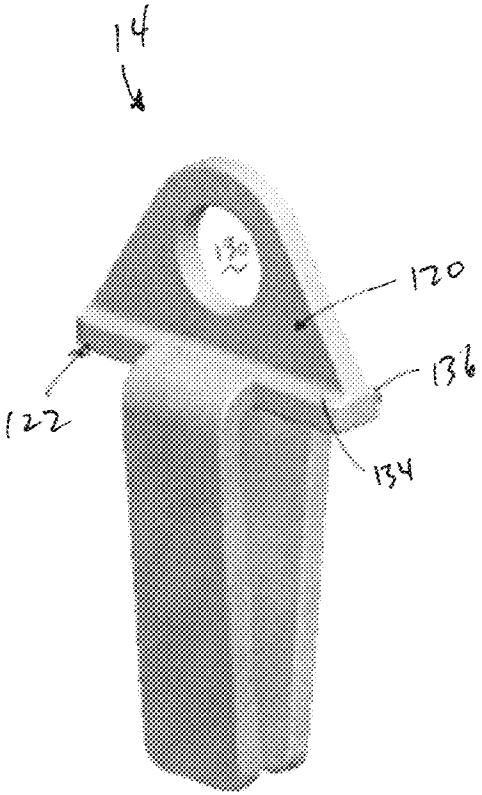
FIG. 4A is a perspective view of another embodiment of a blade hang tab.

FIGS. 4A-4C illustrate another embodiment of a blade hang tab 14. The blade hang tab 14 includes a hang member 120 having an aperture 130 formed through the thickness thereof. A base member 122 extends substantially perpendicular to the hang member 120, and the base member 122 includes a forward end 134 and a rearward end 136. The blade hang tab 14 includes a first leg 124 extending from the forward end 134 and a second leg 126 extending from the rearward end 136. The first and second legs 124, 126 extend at an angle and in a direction opposite the hang member 120. The first and second legs 124, 126 have substantially the same length and width.

Figure 5:
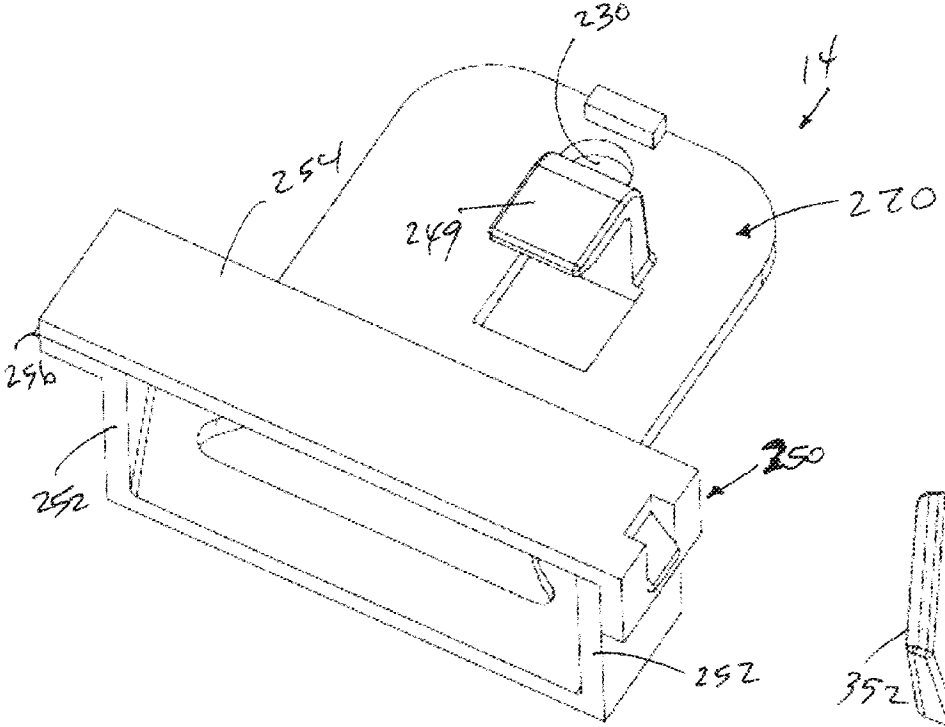
FIG. 5 is a perspective view of yet another embodiment of a blade hang tab.

FIG. 5 shows another embodiment of a blade hang tab 14. The blade hang tab 14 includes a hang member 220 having an aperture 230 formed through the thickness thereof for receiving a retail hook therein. A positioning protrusion 249 extends from the hang member 220, and the positioning protrusion 249 is configured to receive the distal end 18 of the mower blade 12 to properly position the mower blade 12 relative to the blade hang tab 14. The blade hang tab 14 further includes a clip member 250 extending from the hang member 220 and integrally formed therewith. The clip member 250 includes opposing tabs 252 configured to receive and contact the sides of a mower blade 12. The tabs 252 are configured to support the weight of the mower blade 12. A clasp 254 is integrally formed with one of the tabs 252 and is rotatable at a joint 256 formed therebetween. The clasp 254 is configured to rotate between an opened position and a closed position. FIG. 5 shows the clasp 254 in the closed and locked position for securing the mower blade 12 to the blade hang tab 14. The clasp 254 is rotatable to an opened position to allow the mower blade 12 to be easily removed from the blade hang tab 14 or positioned against the blade hang tab 14.

Figure 6:
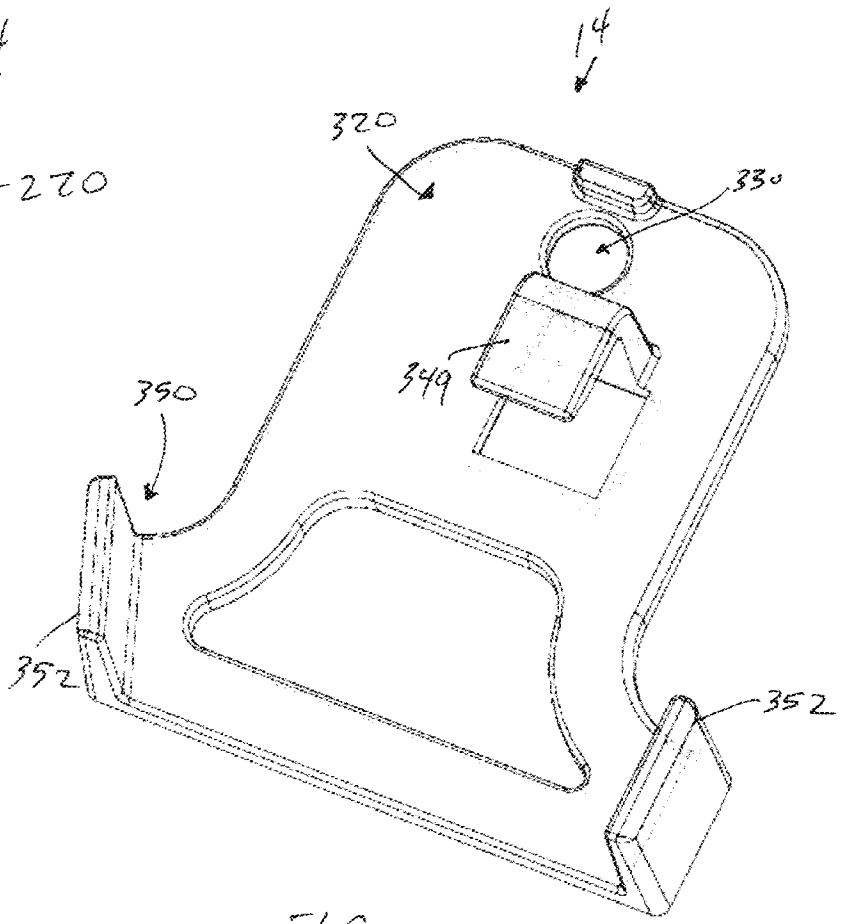
FIG. 6 is a perspective view of a further embodiment of a blade hang tab.

FIG. 6 illustrates another embodiment of a blade hang tab 14, which is similar to the blade hang tab shown in FIG. 5 but without the clasp. The blade hang tab 14 includes a hang member 320 having an aperture 330 formed through the thickness thereof for receiving a retail hook therein. A positioning protrusion 349 extends from the hang member 320, and the positioning protrusion 349 is configured to receive the distal end 18 of the mower blade 12 to properly position the mower blade 12 relative to the blade hang tab 14. The blade hang tab 14 further includes a clip member 350 extending from the hang member 320 and integrally formed therewith. The clip member 350 includes opposing tabs 352 configured to receive and contact the sides of a mower blade 12. The tabs 352 are configured to support the weight of the mower blade 12.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A package assembly for at least one replacement mower blade comprising:

at least one mower blade;

a blade hang tab removably attachable to one of said at least one mower blade, wherein said blade hang tab includes at least two opposing legs, wherein said mower blade is positionable between said at least two opposing legs when said blade hang tab is attached to said mower blade; and a shrink film encasing said at least one mower blade and said blade hang tab attached to one of said at least one mower blade.

2. The package assembly of claim 1, wherein said blade hang tab includes a hang member having an aperture formed therethrough, wherein said opposing legs of said blade hang tab contact opposing surfaces of said mower blade when said blade hang tab is attached thereto.

3. The package assembly of claim 2, wherein a third leg extends from a tip of said second leg toward said hang member, said tip forming an end of said second leg opposite said hang member.

4. The package assembly of claim 1, wherein said shrink film is formed of polyolefin.

5. The package assembly of claim 1, wherein said blade hang tab is formed of glass-filled nylon, high density polyethylene (HDPE), or nylon 6-6.

6. The package assembly of claim 1, wherein only one said mower blade is encased within said shrink film.

7. The package assembly of claim 1, wherein a plurality of mower blades are encased within said shrink film.

8. A package assembly for at least one replacement mower blade comprising:

at least one mower blade;

a blade hang tab removably attachable to one of said at least one mower blade, wherein said blade hang tab includes a hang member, a base member extending from said hang member in a forward manner and a rearward manner, a first leg extending from a first end of said hang member, and a second leg extending from an opposing end of said hang member; and a shrink film encasing said at least one mower blade and said blade hang tab attached to one of said at least one mower blade.

* * * * *